US007062819B2

(12) United States Patent
Patelli et al.

(10) Patent No.: US 7,062,819 B2
(45) Date of Patent: Jun. 20, 2006

(54) SYSTEM FOR GUIDING AND DRAWING ALONG MOBILE FLATS IN A FLAT CARD

(75) Inventors: Silvano Patelli, Palazzolo Sull 'Oglio (IT); Marco Facchinetti, Palazzolo Sull 'Oglio (IT); Giovanni Battista Pasini, Palazzolo Sull 'Oglio (IT)

(73) Assignee: Marzoli S.p.A., Brescia (IT)

( * ) Notice: Subject to any disclaimer, the term of this patent is extended or adjusted under 35 U.S.C. 154(b) by 415 days.

(21) Appl. No.: 10/032,388

(22) Filed: Dec. 20, 2001

(65) Prior Publication Data

US 2002/0094764 A1 Jul. 18, 2002

(30) Foreign Application Priority Data

Dec. 28, 2000 (IT) ..... MI2000A2840

(51) Int. Cl.
*D01G 15/02* (2006.01)

(52) U.S. Cl. ..... 19/102; 19/111

(58) Field of Classification Search ..... 15/312.1, 15/256.53; 19/102, 103, 104, 107, 108, 109, 19/110, 111, 112, 113, 98, 115 B, 218, 263; 451/109, 110

See application file for complete search history.

(56) References Cited

U.S. PATENT DOCUMENTS

| | | | | |
|---|---|---|---|---|
| 3,376,610 | A * | 4/1968 | Williams | 19/107 |
| 4,353,149 | A * | 10/1982 | Demuth et al. | 19/107 |
| 4,368,561 | A * | 1/1983 | Trutzschler | 19/111 |
| 4,559,674 | A | 12/1985 | Rimmer et al. | |
| 4,580,318 | A | 4/1986 | Varga | |
| 4,759,102 | A * | 7/1988 | Verzilli et al. | 19/111 |
| 4,996,746 | A * | 3/1991 | Verzilli et al. | 19/111 |
| 5,271,125 | A | 12/1993 | Leifeld et al. | |
| 5,473,795 | A | 12/1995 | Spix et al. | |
| 5,542,154 | A | 8/1996 | Demuth et al. | |
| 6,052,871 | A * | 4/2000 | Patelli et al. | 19/109 |
| 6,353,972 | B1 * | 3/2002 | Berner | 19/102 |

* cited by examiner

*Primary Examiner*—Timothy V. Eley
(74) *Attorney, Agent, or Firm*—James V. Costigan; Hedman & Costigan

(57) ABSTRACT

A cogged-belt drive device for drawing along mobile flats of flat cards, in which the cogged belts are equipped, in their development facing the flat guides, with scraping or cleaning elements that eliminate the accumulation of foreign bodies from the guides on which the resting elements of the card flats are drawn along.

13 Claims, 6 Drawing Sheets

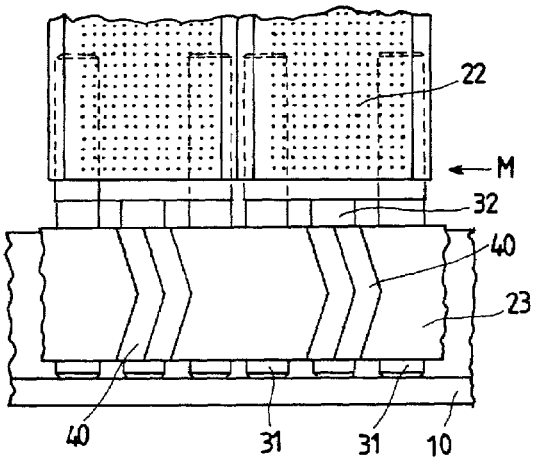
Fig.4
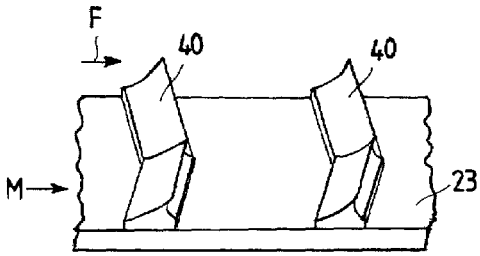
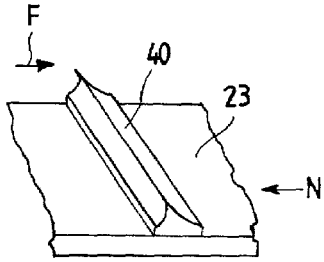
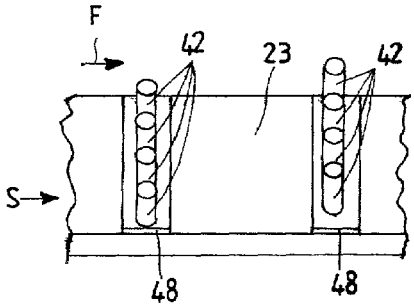
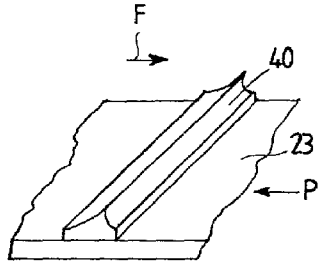
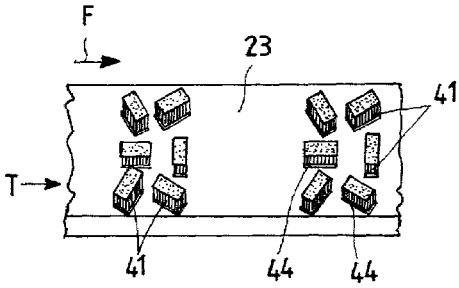
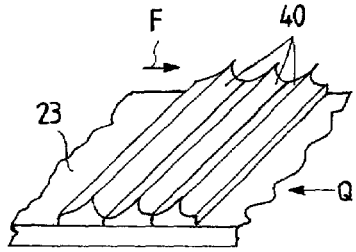

SYSTEM FOR GUIDING AND DRAWING ALONG MOBILE FLATS IN A FLAT CARD

The present invention relates to flat cards in which the fibre material in a thin layer is processed in a series of passes between surfaces facing one another, in relative motion and equipped with a multiplicity of pins, between which the staple fibre material is opened and the smallest particles of residual dirt, as well as waste and tangles or neps, are eliminated. During the carding process, the fibres are mixed together to form a blend. The card product consists of a ribbon of substantially parallel fibres, which are to be sent on to the subsequent processing stages in order to produce yarn.

To illustrate the problems involved in the carding process that the present invention tackles, operation of a flat card is schematically illustrated with reference to FIG. 1.

The raw material 1, consisting of fibre staple in the form of a mat, is fed to the card by a feed roller 2 which, together with the feed board 3 set opposite to it, supplies a wisp or bundle 4 of the mat to the taker-in roller 5, which is also commonly referred to as "licker-in roller" or simply "licker-in", currently also "briseur". The said licker-in is provided with a clothing of pins, and turns at a considerable speed of rotation. The fibres of the wisp or bundle 4 fed to the licker-in are distributed on the clothing of the licker-in and are combed and roughly disentangled. Along their path on the licker-in, the fibres encounter fixed segments provided with pins and knives for removing any impurities that may be present, and then pass on to the subsequent carding drum 6. The said carding drum is, in fact, driven at a peripheral speed that is higher than the speed of the licker-in, and the pins of the carding drum remove the layer of fibres in positions corresponding to the closest generatrices between the two cylinders.

Set in a position corresponding to the top part of the carding drum 6 are the mobile flats 7. The said mobile flats are bars having a working length corresponding to the width of the cylindrical surface of the carding drum 6 and are a few centimeters wide. The parts of the mobile flats that are to face the covered surface of the carding drum 6 are also provided with a clothing of pins. In general, the mobile flats move at a low speed, either in the same direction as the carding drum, or else in the opposite direction, the said carding drum turning, instead, at a considerable speed. The respective clothings set opposite to one another carry out the typical carding action, spreading out and cleaning the fibres. The peripheral speed of the carding drum is in general in the region of 15–40 meters per second, whilst the speed of the flats is in the region of a few centimeters per minute.

The flats 7 thus circulate about the periphery of the carding drum, being driven by a drive member 8, for example chains or cogged belts which circulate in a closed loop between a set of toothed driving and guide wheels 9. Along the carding path between the carding drum and the flats, the flats are guided by guides 10 which are adjusted with extreme precision in order to determine the distances between the clothing of pins of the carding drum and the clothing of the flats, the said precision being essential for the quality of processing. The guides 10 are set at the edges of the plane faces of the carding drum, and the end parts of the flats 7, which are not provided with pins, slide on them. The fibres that are spread out and purified on the carding drum 6 are then removed by a discharging cylinder 11 and discharged by means of detaching or doffing cylinders (not shown in the figure).

In traditional techniques, the bodies of the flats are generally made of cast ferrous material, typically cast iron, and to said bodies there are then applied the clothings of pins for carding. The said traditional flats are generally driven by means of drive chains, to which the flats are fixed by means of bushings, brackets and various supports, both in the articulations and in the plates of the chains, and by means of screw elements, circlips, shape-fits, and so forth. The said type of construction meets the requirements of reliability, reproducibility, rigidity, and durability, but from the constructional, running, installation and maintenance standpoints the carding machine presents heavy burdens and high costs.

For the above reasons, cards of more recent conception adopt a lighter and more economical type of construction, for example using aluminium section or light-alloy section to make the bodies of the card flats, the card clothings being then fixed on said bodies. The above flats, which are generally produced starting from T-section bars with a hollow section so that they have an appropriate moment of inertia, meet the need for a good flexural and torsional rigidity and are lighter and on the whole less costly, even though a material of higher quality is used. For these lighter flats, in general drive systems are used with cogged belts instead of the traditional metal chains.

The European patent application EP-A-361 219, in the name of Truetzschler GmbH, describes a flat-card system of the above type. The European patent application EP-A-567 747, again in the name of Truetzschler GmbH, describes insertion of more resistant cylindrical supporting pins in the end parts of the flats, so that said pins can be rested on the guides 10 instead of the ends of the light-alloy section, which are more subject to wear.

The European patent application EP-A-627 507, in the name of Maschinenfabrik Rieter AG, describes a flat-card system of this type with connection between the flat and the cogged drive belt by means of the supporting pins themselves that slide on the guides 10.

The European patents EP 794 271 and 794 272, in the name of the present applicant, describe systems of engagement between the card and the cogged belt with guides for supporting the flats on the active and inactive paths of the card. These systems envisage the use of pins for engagement between the cogged belt and the flats, as well as distinct elements for sliding of the flats on the guides.

The technical solutions according to the prior art share the problem that during the carding process there is a substantial accumulation of foreign bodies, grit, dust, short fibres, neps, and other impurities which tend to get deposited on the guides 10. This layer, albeit small, of foreign bodies adhering to the guides is the cause of a number of drawbacks which are by no means negligible. One of these drawbacks derives from the fact that the distance between the clothings of the carding drum and of the flats is affected by the existence of the above layer, and this jeopardizes the reliability of the adjustments of the distance at which the flat follows the direction of the guides 10.

A highly detrimental drawback results from the fact that the said layer of foreign bodies that accumulates on the guides 10 exerts an abrasive action, which causes erosion and consumption of the parts of the pins for supporting the flats that come into contact with the guides. The fact that the parts of the supporting pins are consumed consequently calls for maintenance interventions on the plurality of flats in order to restore proper operation of these elements and to adjust the distances between the clothings.

The purpose of the present invention is to provide a driving and guiding system that is particularly, but not exclusively, suited to the type of light flat with cogged-belt drive for said flat cards, in which the drawbacks existing in drive systems according to the prior art—and due to the depositing of foreign bodies on the guides 10—will be drastically reduced, if not eliminated altogether.

The device according to the invention is defined, in its essential components, in claim 1, whereas its variants and preferential embodiments are specified and defined in the dependent claims. As emerges from the ensuing description, the ensemble for moving the mobile flats coupled to their drive system, and in particular to the cogged belts, is equipped, in its closed-loop development, with one or more scraping or cleaning elements, which eliminate, or at least hinder and thus effectively cut down, the depositing and accumulation of foreign bodies on the guides 10 on which the supporting elements of the flats are drawn along.

In order to illustrate more clearly the characteristics and advantages of the present invention, the invention will now be described with reference to a number of typical embodiments thereof, illustrated in FIGS. 2 to 5 purely by way of non-limiting example.

The aforesaid figures refer to the belt-flat-guide system according to the invention, and also to various examples of embodiment of the said scraping or cleaning members, in order to illustrate the characteristics and benefits deriving from the present invention.

As already mentioned, FIG. 1 illustrates the general scheme of a flat card in order to highlight the requirements and problems of the carding operation.

FIG. 4 illustrates, by way of example, the various alternative shapes and structures of the scraping or cleaning elements applied to the cogged belt for the examples of solutions illustrated in FIG. 3.

Figure 1:
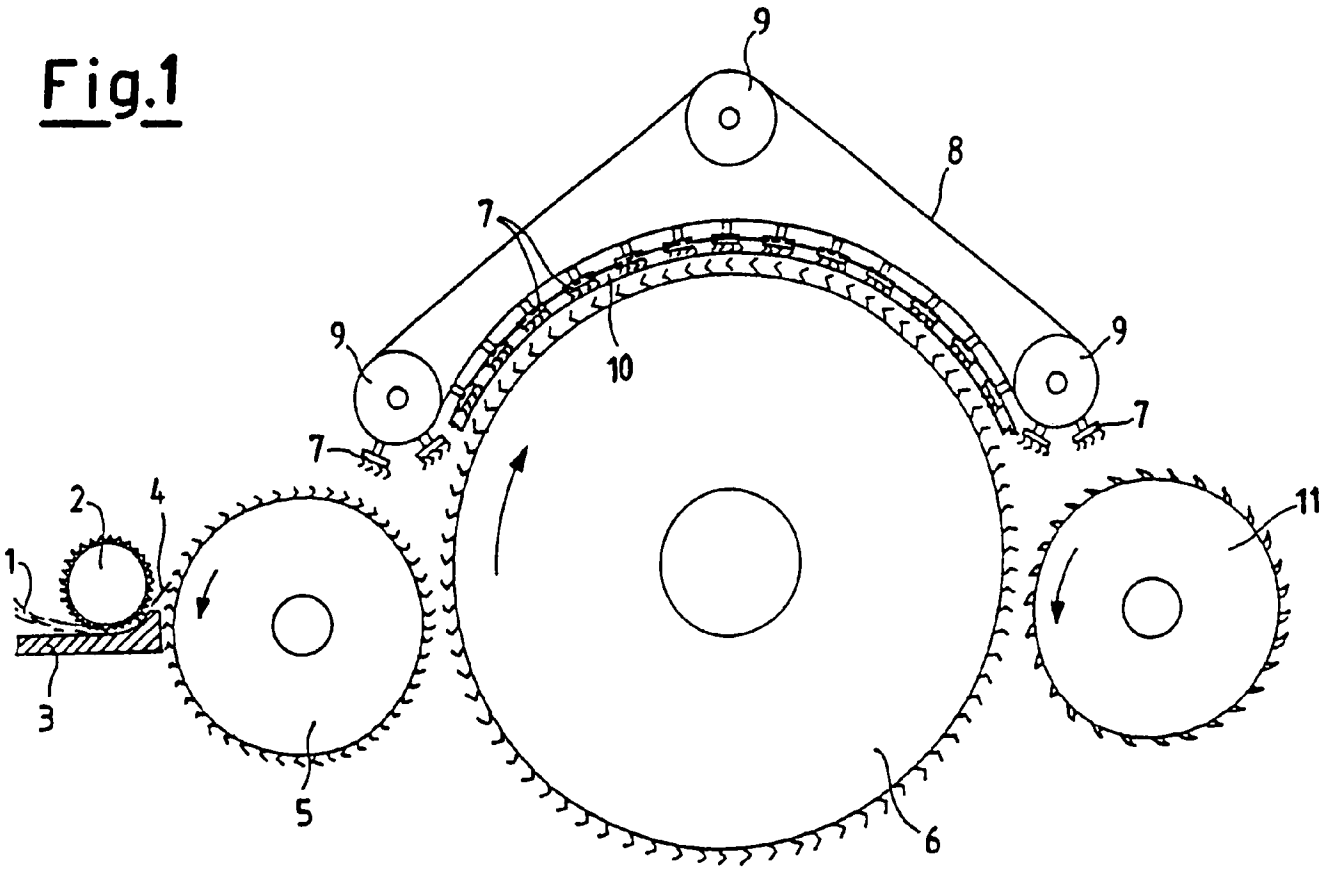
Fig.1 PRIOR ART

In FIG. 2, the flat 7 is illustrated in its typical reversed-T section in order to present a sufficient stiffness to bending loads between the two guide supports 10, one on the front (in view) and one on the opposite side (not in view). The web 20 of the T-section is hollow in order to reduce the weight, at the same time maintaining the characteristics of rigidity. The body of the flat is typically made from sectional bar of indefinite length and cut to size for a length smaller than the distance between the guides 10. The bottom face 21 of the body is covered with a carding cloth 22, indicated in the drawing by a series of pins.

Figure 2A:
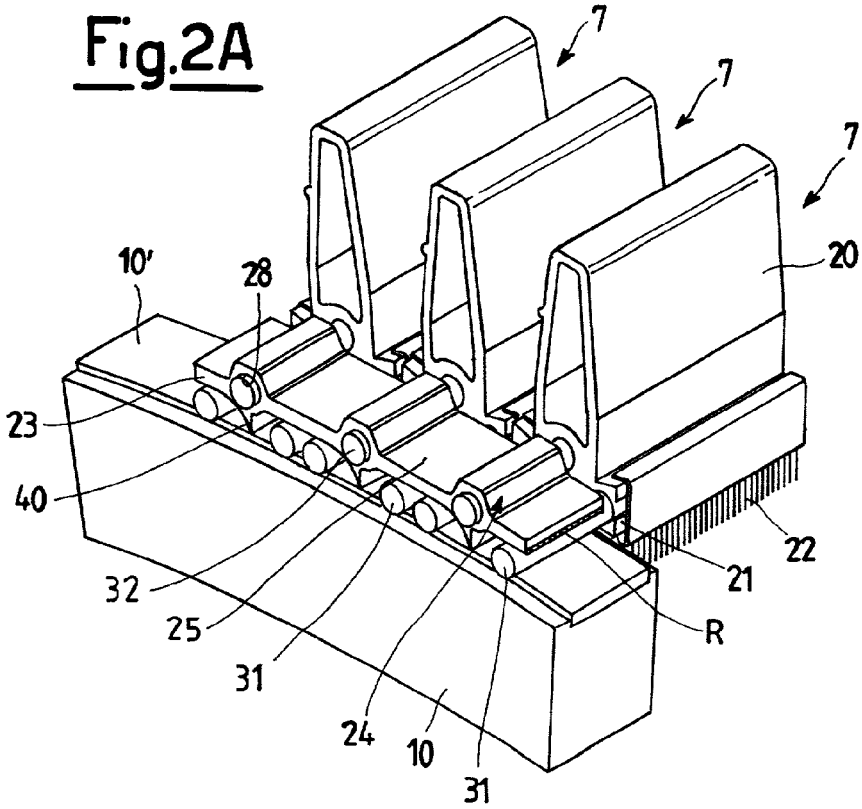
FIG. 2A is a perspective view illustrating a short stretch of the flat-cogged belt system along its active path on the guide 10.
Figure 2B:
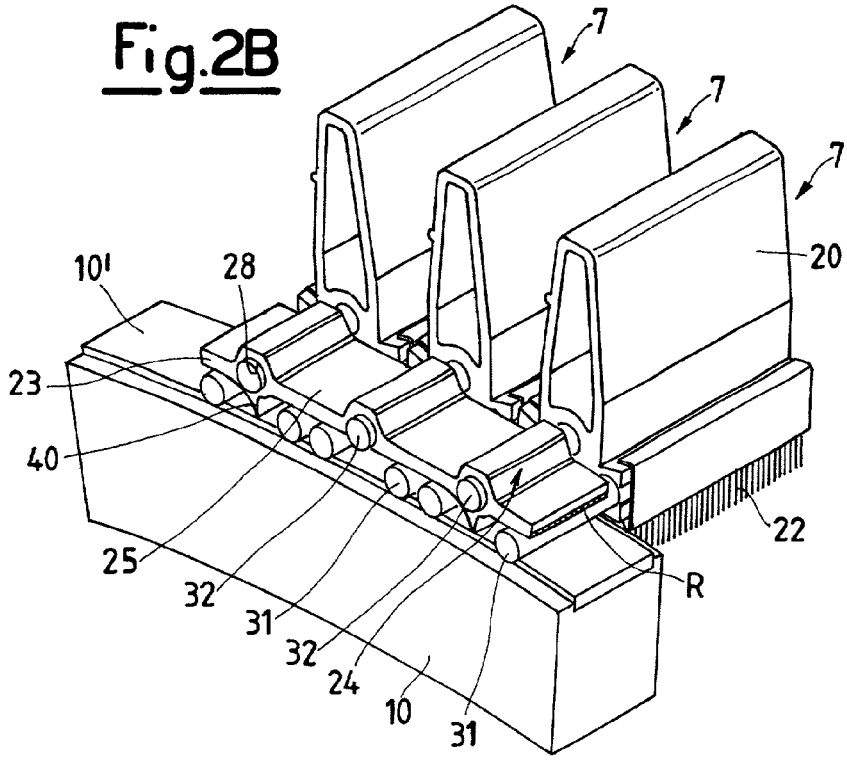
FIG. 2B illustrates a variant of this system.

The member for drawing along the flats 7 consists of a cogged belt 23, in general made of flexible materials, for instance elastomeric materials with possible longitudinal reinforcements R with yarn consisting of textile fibres and/or metal wires. The cogged belt 23 has prismatic enlarged portions 24 or else portions that project in its top face. The said enlarged portions 24 can perform both the function of body for constraint with the mobile flats 7 and the function of toothing or cogging for providing gripping, by means of their protruding profiles, with the toothed driving and return-idler wheels 9. The enlarged portions 24 are set apart from one another by a series of lower portions 25, and—in the embodiment according to FIGS. 2A and 2B—are at a distance apart equal to the pitch of the flats and correspond to the pitch of toothing of the toothed wheels 9. In the body of each enlarged portion 24 there is made a cylindrical cavity 28, in general having a circular section, designed to house the coupling element for connection with the flats 7. This cylindrical cavity 28 may, in its variant embodiments, illustrated by way of example in FIG. 3, be closed and constitute a through hole, as shown in FIGS. 2A and 2B, or else may be open at the bottom or at the top, as is, for instance, described in greater detail in the previously cited European patents EP 794 271 and 794 272 in the name of the present applicant.

On the end faces at the two ends of the body of each flat 7, and in particular on the part opposite to the web 20, i.e., the part forming the cross-member, there are fixed in a position closest to the face 21 two pins 31 made of wear-resistant material, for instance alloyed steel, oriented in the direction of the axis of the flat and designed to slide on the guides 10 of the card, supporting the flats 7 in their active working path with their clothings 22 set facing the carding drum 6.

Again on the end faces of the body of each flat 7, but in a position relatively further away from its bottom face 21, there is fixed a horizontal pin 32 having a circular cross section and designed to be inserted into the cylindrical cavity 28. The pin 32 is of a shape corresponding to, and a size consistent with, said cavity. According to a preferred embodiment of the invention, it has a cylindrical shape with a circular cross section in order to obtain drawing of the flat 7 along its working path on the guides 10 and to enable freedom of rotational movement of adaptation of the pin 32 with respect to the cavity 28 and to enable the flat 7 to adhere precisely to the profile of the guides 10.

The pins 31 that support the flat 7 on the guides 10 and 32 for engagement of the flat to the belt 23 can be fixed to the body of the flat in a way in itself known, for example with forced connection, or else with screwed connection.

A peculiar component of the system according to the present invention is constituted by the scraping and/or cleaning elements, which eliminate or at least effectively hinder the depositing and accumulation of foreign bodies on the guides 10. The said scraping and/or cleaning elements are positioned in the bottom face of the belt 23 which draws the flats along their active path on the guides 10. In the example of embodiment illustrated in FIGS. 2A and 2B, the said scraping elements consist of blades 40 which project from the bottom face of the belt 23 on the side opposite to the enlarged portions 24. Typically, the said blades 40 are flexible and have a height sufficient to enable them to project substantially below the resting level of the pins 31, with the belt constrained to the flat 7, so as to come into contact and rest with all their transverse development on the surface of the guide 10 set opposite to them, in order to present a sliding motion, which is continuous over the entire resting surface of the supporting pins 31 that rest on the guide 10, as a result of the relative motion of the belt 23 for drawing along the flats. According to a preferred embodiment of the invention, on the development of the guides 10 there are interposed one or more strips of surface-treatment material 10' presenting good characteristics of sliding, finish and wear resistance, in order to reduce the friction and resistance to motion of the flats 7.

In FIG. 2A, the aforesaid scraping blades 40 are set underneath all the enlarged portions 24 in positions corresponding to each flat 7. The said enlarged portions all perform both the function of constraint with the flats and the function of drive toothing. The said scraping elements could, alternatively, be different in number from the flats 7 and be distributed along the part of the cogged belt 23 which faces its guide 10, for example a scraping element every two flats (as illustrated in FIG. 2B) or every three or more flats. The said scraping elements may be of a type, shape or material that is the same as or different from one another. The blades 40 may be either set at right angles to the longitudinal direction of the belt 23 or at an angle that is greater or less than 90°, in order to exert an action of displacement of the impurities removed as the blades pass over the guides 10 towards the inside of the carding drum, or else towards the outside of the carding drum. Some of the alternative embodiments of the cleaning elements are illustrated later on, both in the form of blades 40 and in other forms.

Figure 3:
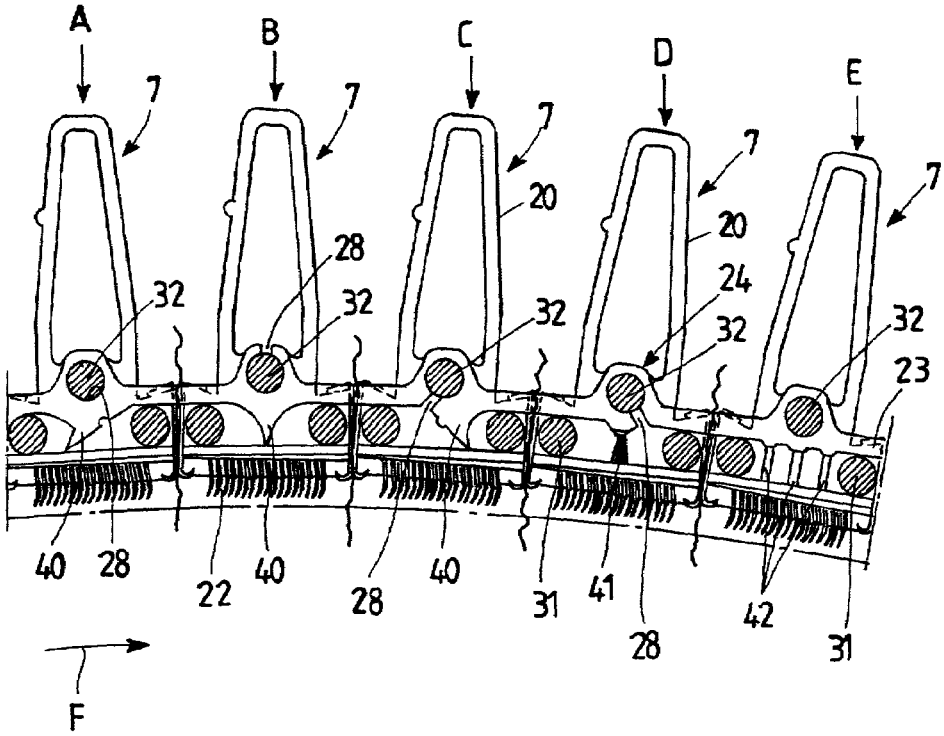
FIG. 3 illustrates variant embodiments of the constraint between the flat, the belt, and the scraping element.

FIG. 3 illustrates a plurality of the said variant embodiments—arranged along one and the same length which exemplifies a cogged belt 23—of the constraint between the flat and the belt, the incidence of the blade 40, and finally the alternative forms of the blade. In these variants, all the enlarged portions 24 of connection of the belt 23 to the flats 7 also have the function of teeth or cogs for engaging the toothed driving and return-idler wheels 9.

From left to right, along the length of the belt 23 there is shown a first variant A. Here, the flat 7 is constrained with its pin 32 inside a closed cavity 28 made within the body 24. Beneath this constraint there is a blade 40 which performs a "positive" scraping action; i.e., it detaches the layer of impurities, with a rake against the impurities that come up against it as the carding drum 6 proceeds in its clockwise motion, as indicated by the arrow F.

Again proceeding towards the right, along the length of the belt 23, after the variant A, there is a second variant B. Here, the flat 7 is constrained with its pin 32 in a cavity 28 open at the top and made inside the enlarged portion 24. When open cavities 28 are adopted, insertion and extraction of the pins 32 is facilitated by forcing the cavities open during these operations. Beneath this constraint there is a blade 40 performing a "neutral" scraping action, i.e., without any inclination either opposing the rotational motion of the carding drum 6 or slanting in the direction of the rotational motion of the carding drum 6.

According to the next variant C, the flat 7 is constrained with its pin 32 in a cavity 28, which is open at the bottom and towards the left and is made in the enlarged portion 24. Beneath the enlarged portion 24, which has a function of constraint, there is a blade 40 which performs a "negative" scraping action; i.e., it pushes the incoherent impurities with an inclination that goes in the same direction of motion as the clockwise motion of the carding drum 6.

According to the next variant D, the flat 7 is constrained with its pin 32 in a cavity 28 open at the bottom and towards the right, which is made in the enlarged portion 24. Beneath the enlarged portion 24, which has a function of constraint, there is a cleaning element made up of a series of brushes 41 of bristles arranged along the part of the cogged belt 23 that faces its guide 10, the said brushes 41 performing an action of brushing away the dust or other incoherent particles.

According to the last variant E, the flat 7 is constrained with its pin 32 set in the same way as in the variant A. Beneath the enlarged portion 24 there is a scraping element made up of a series of soft rubber studs 42, which are arranged radially and exert an action of detachment by friction of the impurities from the guides 10 in a way similar to that of a rubber for erasing.

FIG. 4 shows, by way of example, the various alternative shapes and structures of the cleaning elements illustrated by way of example in FIG. 3.

The variant M relates to an embodiment of the blades 40 of the variants A, B and C of FIG. 3, where the blades present a V-shaped development that tends to withhold the impurities detached from the surface of the guides 10 and to bring them up to a discharging device set downstream of the active path. In the perspective view of the variant M appearing underneath, an embodiment is illustrated by way of example, in which the blades 40—the V-shaped blades, the blades with a rectilinear transverse development, the brush-type elements 41, or the rubber-stud-type elements 42—may be advantageously prepared separately, possibly using different materials. The said scraping and/or cleaning elements are then appropriately fixed, for example with adhesives, to the bottom face of the belt 23.

The variant N again relates to an embodiment of the blades 40 of the variants A, B and C of FIG. 3, where, instead, the blades present a straight development that tends to push the impurities detached from the surface of the guides 10 towards the inside of the carding drum 6, from which removal and discharge of the impurities takes place by suction.

The variant P relates to the same embodiment of the blades 40 of the previous variant N, where the blades are oriented so that they push the impurities detached from the surface of the guides 10 towards the outside of the carding drum 6.

The variant Q relates to the same embodiment of the blades 40 of the previous variant P, where each cleaning element is made up of a sequence of blades, again oriented so that they push the impurities towards the outside of the carding drum 6.

The variant S relates to an embodiment, provided purely by way of example, of the scraping element 42, made up of a plurality of rubber studs 42 arranged in a radial direction. The said variant S relates to an embodiment, again provided purely by way of example, in which the studs are prepared separately—possibly using different materials—and aligned on transverse supporting strips 48, which are in turn appropriately fixed to the bottom face of the belt 23. FIG. 4 illustrates two consecutive strips 48 with the respective studs 42 staggered in such a way as to cover the entire surface of the guides 10 as they pass over them.

The variant T relates to an embodiment, given by way of example, of the bristle-type cleaning element 41, where the bristles are grouped together to form brushes arranged in a radial direction. Also in this variant the brushes are produced separately, each with a corresponding fixing base 44 which is fixed to the bottom face of the belt 23. Also the brushes 41 are mounted so that they are staggered in such a way as to cover the entire surface of the guides 10 as they pass over them.

The various types of scraping and/or cleaning elements illustrated above purely by way of example may be advantageously used in conjunction with one another on the same cogged belt, by associating in sequence, for example, scraping blades of different inclination, material and orientation, and elements for removing the material that is scraped off, i.e., brush-type or stud-type elements.

Figure 5A:
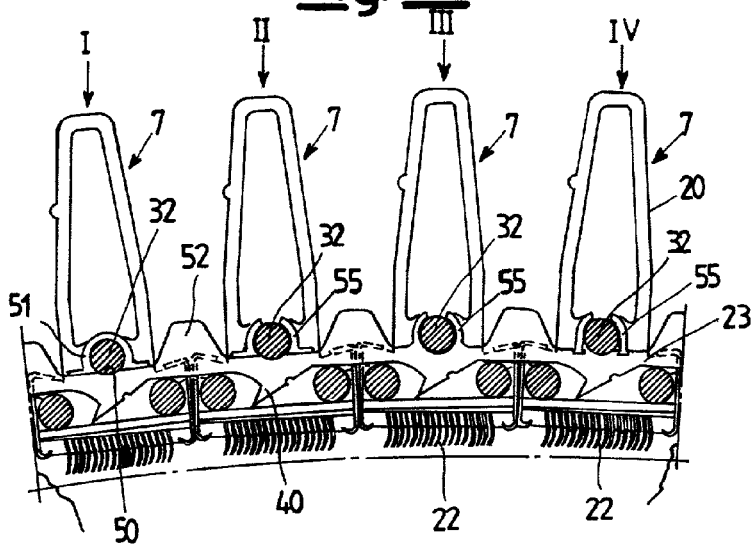
FIGS. 5A, 5B and 5C illustrate variant embodiments of the connection between the belt, the flat, and the cogged wheel illustrated in the previous figures.
Figure 5B:
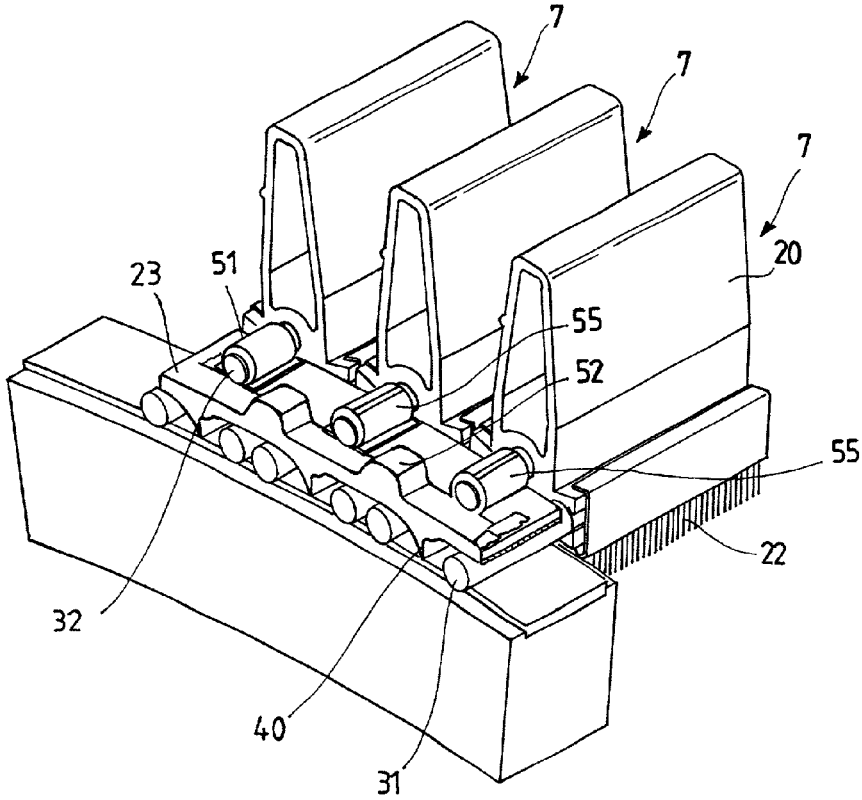
Figure 5C:
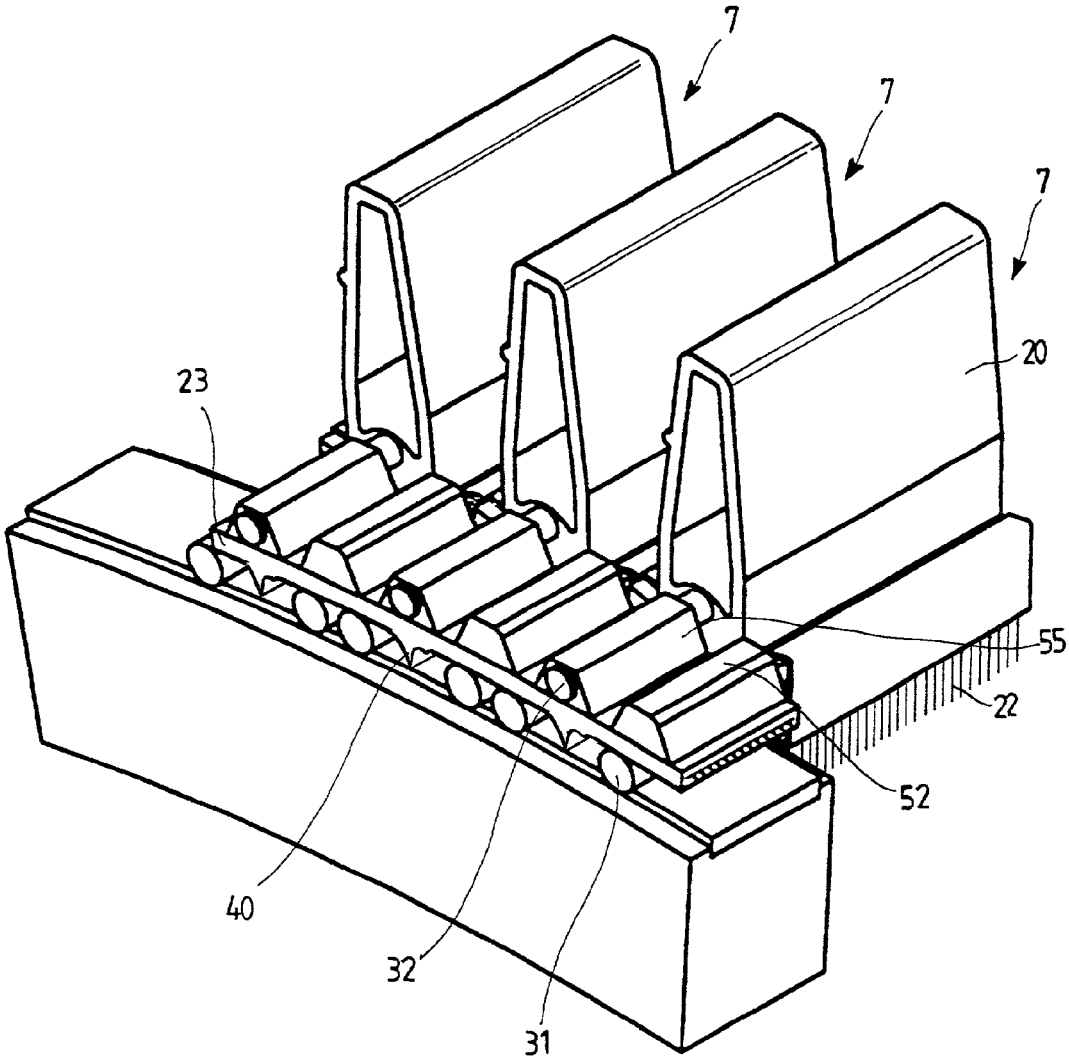

The embodiments illustrated in FIGS. 5A and 5B show belt-flat couplings that are alternative to the ones illustrated in FIGS. 2 to 4. In the variants illustrated in FIG. 5, the scraping blade 40 is shown as being similar to that of the variant A of FIG. 3 with a "positive" scraping action, i.e., with an inclination that opposes the clockwise motion of the carding drum 6. In the variants appearing in FIG. 5, the enlarged portions of connection of the belt 23 are applied to the belt alternately to function only as a constraint for the flats 7 and to function only as cogs for meshing with the toothed driving and return-idler wheels 9.

Proceeding from left to right, along the length of the belt 23 there is a first variant I. Here, the flat 7 is constrained with its pin 32 inserted in a corresponding cylindrical closed cavity 50 made in the body of a separate element 51, produced separately and then applied to the surface of the belt 23 opposite to the one on which the blades 40 are applied, or other elements for cleaning away the deposits, applied by gluing or using equivalent fixing techniques. Amongst the series of separate elements 51 for constraining the flats 7 there is alternately set a series of separate bodies 52 with profiles—in general shaped like trapezial prisms—corresponding to those of the toothing of the wheels 9 and designed to mesh with the said toothing, in order to transmit driving motion for circulation of the mobile flats. Also the said bodies or cogs 52 may, for example, be produced separately and may be subsequently applied to the belt 23 using adhesives or equivalent fixing techniques. In order to prevent the series of bodies 51, which may possibly be made with different profiles, from being the cause of complications in meshing of the toothing of the bodies 52 of the belt 23 with the toothing of the wheels 9, the two series of bodies can be transversely staggered, as illustrated by way of example in FIG. 5B. If, instead, the elements 51 for constraining the flats 7 and the bodies 52 designed only to mesh with the toothed wheels 9 have the same profiles corresponding to the toothing of the wheels 9, the two series of said elements or bodies can be made without transverse staggering, as illustrated by way of example in FIG. 5C.

Proceeding towards the right in FIG. 5A, along the length of the belt 23, after the variant I, there is a second variant II, which is repeated for three elements that are the same but are made in a different way. Here, the flat 7 is constrained with its pin 32 to the belt 23 in the body 55 having a cavity that is open at the top, in the form of a reversed Ω, with a base for connection to the belt. Proceeding from left to right, in the first element of the variant II, the body 55 is produced as two specular L-shaped elements set back-to-back, separated from one another and with their longer branches curved backwards. These elements are applied to the surface of the belt 23 so as to form the reversed Ω referred to above. In the second element of the variant II, the body 55 is produced integrally with the belt, in a way similar to the variant B of FIG. 3. In the third element of the variant II, the body 55 is produced as two separate J-shaped elements set face-to-face, which are applied to the surface of the belt 23 with the top stroke or serif of the J, again so as to form the reversed Ω open at the top referred to above.

Also in the case of the variant II, amongst the series of bodies 55 for constraining the flats 7 there is alternately set a series of separate bodies 52 designed to mesh with the toothing of the wheels 9 for transmitting driving motion to enable circulation of the mobile flats.

The invention claimed is:

1. A device for preventing the deposit of foreign bodies on guides (10) of flats (7) said device comprising a drive system for moving the flats (7), which includes guide wheels, having toothed gears (9) and a cogged belt having an inner surface and an outer surface(23), said inner surface is equipped, with one or more scraping or cleaning elements (40, 41, 42) that eliminate the accumulation of foreign bodies from the guides (10)by direct contact of the scraping or cleaning elements (40,41,42) with the guides (10), on which the resting elements of the flats (7) are moved, additionally said outer surface of said cogged belt is equipped with equally spaced raised protuberances (24) for interacting with toothed gears from a cogged belt driving mechanism, each raised protuberance being separated from one another by lower portions (25).

2. The device for preventing the deposit of foreign bodies on guides (10) of flats (7) according to claim 1, wherein the scraping and/or cleaning elements are set in the inner surface of the cogged belt (23) which moves the flats along the guides (10), said scraping and/or cleaning elements being made up of blades (40) which project from the inner surface of the cogged belt (23), on the side opposite to the periodically spaced raised protuberances (24) of said outer surface.

3. The device for preventing the deposit of foreign bodies on guides (10) of flats (7) according to claim 2, wherein the blades (40) are set at right angles to the direction of movement of the cogged belt (23) and toward the guides(10) or at an angle that is greater or less than 90° from the direction of movement of the cogged belt, and towards the guides(10), in order to displace the foreign bodies removed as the blades pass over the guides (10), towards the inside of a carding drum, or towards the outside of said carding drum.

4. The device for preventing the deposit of foreign bodies on guides (10) of flats (7) according to claim 2, wherein the blade (40) is inclined with respect to the direction in which the carding drum moves, in order to exert an action of detachment against the layer of foreign bodies that come up against said blade.

5. The device for preventing the deposit of foreign bodies on guides (10) of flats (7) according to claim 2, wherein the blade (40) is inclined with respect to the direction in which the carding drum moves, in order to exert a pushing action, against said foreign bodies with an inclination that is in the same direction as the direction in which the carding drum moves.

6. The device for preventing the deposit of foreign bodies on guides (10) of flats (7) according to claim 2, wherein the blades (40) have a V-shaped profile.

7. The device for preventing the deposit of foreign bodies in guides (10) of flats (7) according to claim1, wherein the cleaning elements comprise a scraping element (42), consisting of a plurality of rubber studs (42) arranged in a radial direction.

8. The device for preventing the deposit of foreign bodies on guides (10) of flats (7) according to claim 1, wherein the cleaning elements comprise a cleaning element made up op of a series of bristle brushes (41) arranged along the cogged belt (23) in a direction that faces its guide (10).

9. The device for preventing the deposit of foreign bodies in guides (10) of flats (7) according to claim 1, wherein the scraping or cleaning elements (40, 41, 42) are separately fixed to the inner surface of the drive belt (23).

10. The device fore preventing the deposit of foreign bodies on guides (10) of flats (7) according to claim 9, wherein different types of scraping or cleaning elements (40,41, 42) are used jointly on the same cogged belt, wherein scraping elements of different inclination, material and orientation are successively disposed on said cogged belt.

11. The device for preventing the deposit of foreign bodies on guides (10) of flats (7) according to claim1, wherein the scraping or cleaning element (40, 41, 42) are attached to said inner surface of the cogged belt (23) at a position that corresponds to the raised protuberances located on the outer surface of said cogged belt(23) as well as corresponding to the position of a flat (7), and said raised protuberances all perform both a functi0on of constraint with the flats and the function of interacting with a cogged belt driving mechanism to progress the scraping or cleaning element (40, 41, 42) along the guide (10) by means of the raised protuberances and lower portions forming a structure that receives a gear tooth from a cogged belt driving mechanism.

12. The device for preventing the deposit of foreign bodies on guides (10) of flats (7) according to claim 1, wherein the scraping or cleaning elements (40, 41, 42) are set in positions opposite to constraint bodies (51, 55) for connection to the cogged belt (23), said constraint bodies (51, 55) forming cavities to constrain pins (32) of flats (7), and having alternately set separate bodies (52) between said constraint bodies (51,55) with profiles which correspond to the toothing of guide wheels (9) and are designed to mesh with the said toothing of guide wheels (9), in order to transmit driving motion for circulation of flats (7).

13. The device for preventing the deposit of foreign bodies on guides (10) of flats (7) according to claim 12, wherein the constraint bodies (51, 55), wherein the constraint bodies (51,55) and the separate bodies (52) are produced separately and then applied to the belt (23).

* * * * *